US006012318A

United States Patent [19]

Kanemitsu et al.

[11] Patent Number: 6,012,318

[45] Date of Patent: Jan. 11, 2000

[54] METHOD OF PRODUCING A SHEET METAL PULLEY FOR A V BELT

[75] Inventors: Toshiaki Kanemitsu, Kobe; Kunihiro Harada, Miki; Naoki Fujii, Kobe, all of Japan

[73] Assignee: Kabushiki Kaisha Kanemitsu, Hyogo, Japan

[21] Appl. No.: 09/043,116

[22] PCT Filed: Aug. 5, 1996

[86] PCT No.: PCT/JP96/02215

§ 371 Date: Mar. 17, 1998

§ 102(e) Date: Mar. 17, 1998

[87] PCT Pub. No.: WO98/05448

PCT Pub. Date: Feb. 12, 1998

[51] Int. Cl.[7] ..... B21H 1/00

[52] U.S. Cl. ..... 72/71; 72/110; 29/892

[58] Field of Search ..... 72/71, 84, 110; 29/892, 892.2, 892.3

[56] References Cited

U.S. PATENT DOCUMENTS 4,524,595 6/1985 Oda ..... 72/84

FOREIGN PATENT DOCUMENTS 53-56161 5/1978 Japan .

59-166066 11/1984 Japan .

62-84845 4/1987 Japan .

3-94942 4/1991 Japan ..... 72/84

*Primary Examiner*—Lowell A. Larson

*Attorney, Agent, or Firm*—Jones, Tullar & Cooper, P.C.

[57] ABSTRACT

The present invention relates to a method of producing a sheet metal pulley for a V belt without cutting which may impair the environment of a factory. A sheet metal pulley for a V belt which is obtained by the production method of the present invention has plural valley portions around which V belts are to be wound. In the production method, an annular first valley portion which is opened in a V-like shape is formed by slitting a root portion of a cylindrical portion of a sheet metal cylindrical member and an outer periphery of a base plate portion continuous to the root portion. A cylindrical portion continuous to the first valley portion is elongated in the axial direction while being thinned, thereby forming an intermediate shaped member, and, while applying a pressing force in the axial direction to the cylindrical portion of the intermediate shaped member, an intermediate portion in the axial direction of the cylindrical portion is pressed in a radial direction to be inwardly bent, thereby shaping the pressed place into an annular second valley portion. When the cylindrical portion of the sheet metal cylindrical member is sufficiently long, the elongation of the cylindrical portion is not required.

4 Claims, 5 Drawing Sheets

300
a
25
2
26
23
21
200
101
100
21
23
1
22
24

500
501
3
31
25
b
c
A
502
402
23
21
200
401
21
23
400
402
28
2
26
27
25
H1

700
25
d
702
21
23
701
B
602
31
3
601
200
600
602
21
23
31
25
3
H2

METHOD OF PRODUCING A SHEET METAL PULLEY FOR A V BELT

TECHNICAL FIELD

The present invention relates to a method of producing a sheet metal pulley for a V belt, and more particularly to a method of producing a sheet metal pulley for a V belt in which there is no room for the production of material loss due to a cutting operation. A sheet metal pulley for a V belt which is obtained by the production method of the present invention has plural valley portions around which V belts are to be wound. Such a sheet metal pulley for a V belt can be used as a pulley for an alternator of a diesel engine.

BACKGROUND ART

In a prior art pulley for a V belt having plural valley portions around which plural V belts are to be wound, the plural valley portions for winding V belts are formed by a cutting operation. However, such a cutting operation produces a large amount of waste material. This waste material results in a material loss and causes an economical problem. Furthermore, cut chips scatter, and thereby impair the environment of a factory.

SUMMARY OF THE INVENTION

It is an object of the present invention to provide a method of producing a sheet metal pulley for a V belt which does not impair the environment of a factory, which does not produce waste material, and which can produce a sheet metal pulley for a V belt having plural valley portions for winding V belts.

According to the method of producing a sheet metal pulley for a V belt of the present invention, in a sheet metal cylindrical member having a cylindrical portion in an outer periphery of a circular base plate portion, the cylindrical portion extending in elongation on one side of the base plate portion. In the cylindrical portion, on a side of the base plate portion, an annular first valley portion which is opened in a V-like shape is formed by slitting a root portion of the cylindrical portion and the outer periphery of the base plate portion continuous to the root portion, and, in the cylindrical portion on a side opposite to the base plate portion, an annular second valley portion is formed by inwardly bending the cylindrical portion.

This method is suitable for the production of a sheet metal pulley for a V belt around which two separate V belts are to be wound. When this method is employed, a light-weight sheet metal pulley for double V belts can be produced which has the first valley portion formed on the cylindrical portion of the sheet metal cylindrical member by slitting, and the second valley portion formed by bending, and in which the material is not wastefully used.

In the method of producing a sheet metal pulley for double V belts, preferably, in a sheet metal cylindrical member having a cylindrical portion in an outer periphery of a circular base plate portion, the cylindrical portion extending in elongation on one side of the base plate portion, an annular first valley portion which is opened in a V-like shape is formed by slitting a root portion of the cylindrical portion, and the outer periphery of the base plate portion continuous to the root portion, and a cylindrical portion for forming a second valley portion is formed to be continuous to the first valley portion. Thereby, an intermediate shaped member is formed which has the first valley portion in the outer periphery of the base plate portion and in which the cylindrical portion for forming the second valley portion is continuous to the first valley portion, and, while applying a pressing force in an axial direction to the cylindrical portion of the intermediate shaped member, an intermediate portion in the axial direction of the cylindrical portion is thereafter pressed in a radial direction to be inwardly bent, thereby shaping the pressed portion into the annular second valley portion.

When this method is employed, there is merit in the fact that the height of an annular chevron peak formed between the first valley portion and the second valley portion is prevented from being lowered. This enhances the accuracy of the obtained sheet metal pulley for a V belt.

In the method of producing a sheet metal pulley for double V belts, more preferably, in a sheet metal cylindrical member having a cylindrical portion in an outer periphery of a circular base plate portion, the cylindrical portion extending in elongation on one side of the base plate portion, an annular first valley portion which is opened in a V-like shape is formed by slitting a root portion of the cylindrical portion and the outer periphery of the base plate portion continuous to the root portion, and the cylindrical portion continuous to the first valley portion is elongated in an axial direction while being thinned, thereby forming an intermediate shaped member which has the first valley portion in the outer periphery of the base plate portion and in which the elongated cylindrical portion is continuous to the first valley portion, and, while applying a pressing force in the axial direction to the elongated cylindrical portion of the intermediate shaped member, an intermediate portion in the axial direction of the cylindrical portion is thereafter pressed in a radial direction to be inwardly bent, thereby shaping the pressed portion into an annular second valley portion.

When this method is employed, the cylindrical portion for forming the second valley portion continuous to the first valley portion is elongated in the axial direction while being thinned, and hence further weight reduction can be attained. Moreover, the wasteful use of material is further reduced and further reduction of material cost can be attained.

The present invention may be performed in the following manner. In a sheet metal cylindrical member having a cylindrical portion in an outer periphery of a circular base plate portion, the cylindrical portion extends in elongation on one side of the base plate portion. In the cylindrical portion on a side of the base plate portion, an annular first valley portion which is opened in a V-like shape is formed by slitting a root portion of the cylindrical portion, and the outer periphery of the base plate portion continuous to the root portion, and, in the cylindrical portion on a side opposite to the base plate portion, plural annular second valley portions are formed by inwardly bending plural places in an axial direction of the cylindrical portion.

This method is used for the production of a sheet metal pulley for a V belt around which plural (three or more) V belts are to be wound. When this method is employed, a light-weight sheet metal pulley for plural V belts can be produced which has the valley portion formed on the cylindrical portion of the sheet metal cylindrical member by slitting, and the plural valley portions are formed by bending, and in which the material is not wastefully used.

In the method of producing a sheet metal pulley for plural V belts, preferably, in a sheet metal cylindrical member having a cylindrical portion in an outer periphery of a circular base plate portion, the cylindrical portion extends in elongation on one side of the base plate portion, an annular valley portion which is opened in a V-like shape is formed by slitting a root portion of the cylindrical portion and the outer periphery of the base plate portion continuous to the root portion, and a cylindrical portion for forming plural valley portions is formed to be continuous to the valley portion, thereby forming an intermediate shaped member which has the valley portion in the outer periphery of the base plate portion and in which the elongated cylindrical portion is continuous to the valley portion, and, while applying a pressing force in an axial direction to the cylindrical portion of the intermediate shaped member, plural places of an intermediate portion in the axial direction of the cylindrical portion are thereafter pressed in a radial direction to be inwardly bent, thereby shaping the pressed places into plural annular valley portions.

When this method is employed, there is merit in that the height of an annular chevron peak formed between the valley portion formed by slitting and the annular chevron valley portions formed by bending. The heights of the annular peaks formed between the annular valley portions formed by bending are prevented from being lowered. This enhances the accuracy of the obtained sheet metal pulley for a V belt.

In the method of producing a sheet metal pulley for plural V belts, more preferably, in a sheet metal cylindrical member having a cylindrical portion in an outer periphery of a circular base plate portion, the cylindrical portion extending in elongation on one side of the base plate portion, an annular valley portion which is opened in a V-like shape is formed by slitting a root portion of the cylindrical portion and the outer periphery of the base plate portion continuous to the root portion. The cylindrical portion is continuous to the valley portion and is elongated in an axial direction while being thinned, thereby forming an intermediate shaped member which has the valley portion in the outer periphery of the base plate portion and in which the elongated cylindrical portion is continuous to the valley portion, and, while applying a pressing force in the axial direction to the cylindrical portion off the intermediate shaped member, plural places of an intermediate portion in the axial direction of the cylindrical portion are thereafter pressed in a radial direction to be inwardly bent, thereby shaping the pressed places into plural annular valley portions.

When this method is employed, the cylindrical portion for forming plural valley portions and continuous to the valley portion formed by slitting is elongated in the axial direction while being thinned, and hence further weight reduction can be attained. Moreover, the wasteful use of material is further reduced and further reduction of material cost can be attained.

As a more specific production method of the present invention, the following method may be employed wherein a sheet metal cylindrical member having a cylindrical portion in an outer periphery of a circular base plate portion is held in a fitted manner by a first rotary die, the cylindrical portion extending in elongation on one side of the base plate portion, an annular first valley portion which is opened in a V-like shape is formed by slitting a root portion of the cylindrical portion and the outer periphery of the base plate portion continuous to the root portion with pressing a chevron splitting portion provided on a first shaping roller while rotating the sheet metal cylindrical member together with the first rotary die, the cylindrical portion is elongated in an axial direction while being thinned, by pressing the cylindrical portion against a receiving face of the first rotary die and using a shaping face provided on the first shaping roller, thereby forming an intermediate shaped member which has the first valley portion in the outer periphery of the base plate portion and in which the elongated cylindrical portion is continuous to the first valley portion, and, in a state where the base plate portion of the intermediate shaped member is supported by a movable table of a second rotary die which has a rotary table and the movable table which is movable at a concentric position with respect to the rotary table. A shape retaining roller is fitted in the axial direction and it is fitted into the first valley portion of the intermediate shaped member, while an open end of the cylindrical portion of the intermediate shaped member is abutted against the rotary table to apply a pressing force to the cylindrical portion by pressing the intermediate shaped member by a pressing member in the axial direction. An intermediate portion in the axial direction of the cylindrical portion is thereafter pressed by a chevron shaping face provided on a second shaping roller, thereby shaping the pressed place into an annular second valley portion having a shape which extends along the chevron shaping face.

According to this method, the production of the above-mentioned sheet metal pulley for a V belt around which two separate V belts are to be wound can be efficiently produced.

DESCRIPTION OF THE PREFERRED EMBODIMENTS

Figure 1:
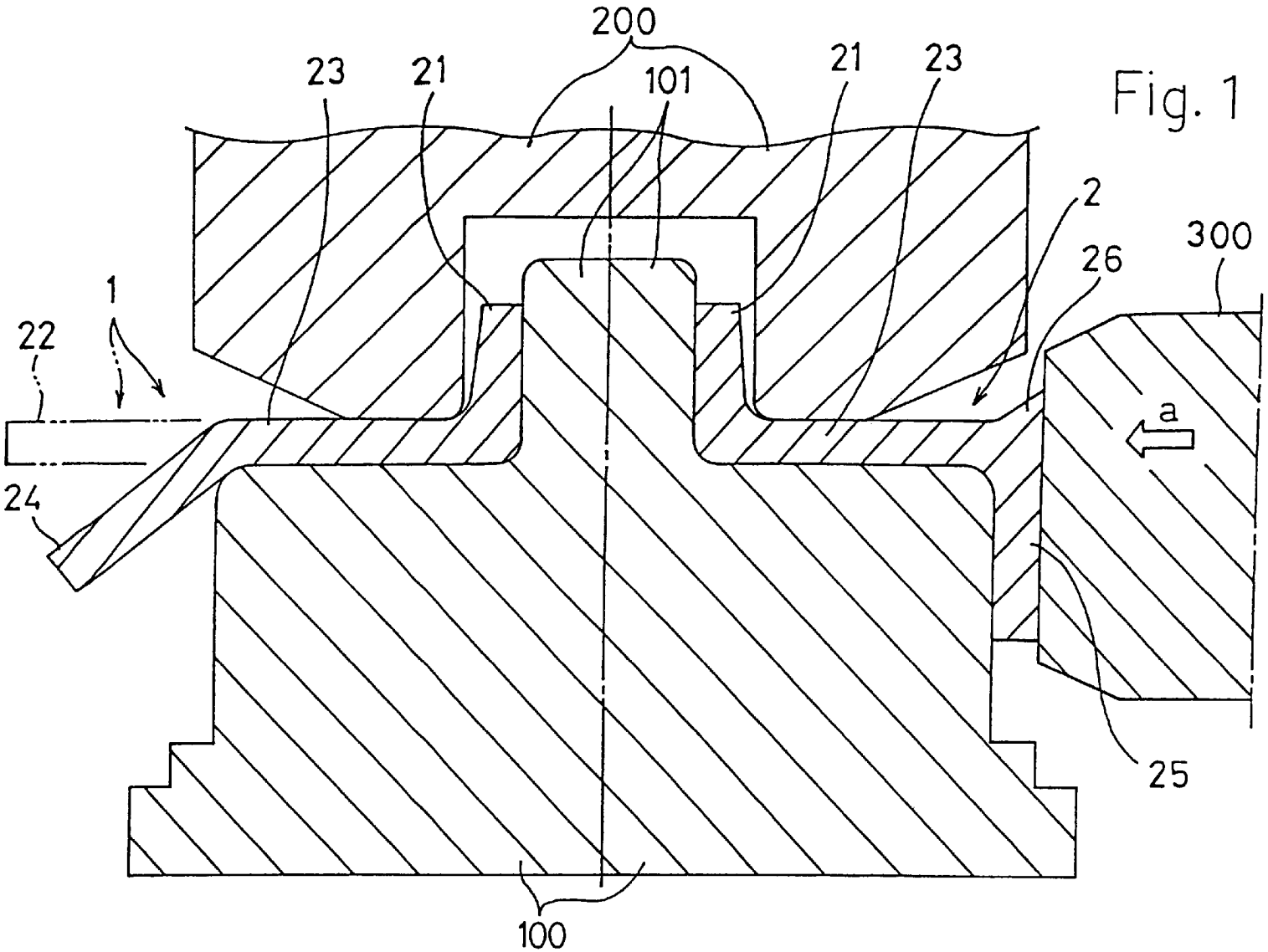
FIG. 1 is a section view showing a cylindrical portion shaping step which is performed for forming a sheet metal material into a sheet metal cylindrical member.
Figure 2:
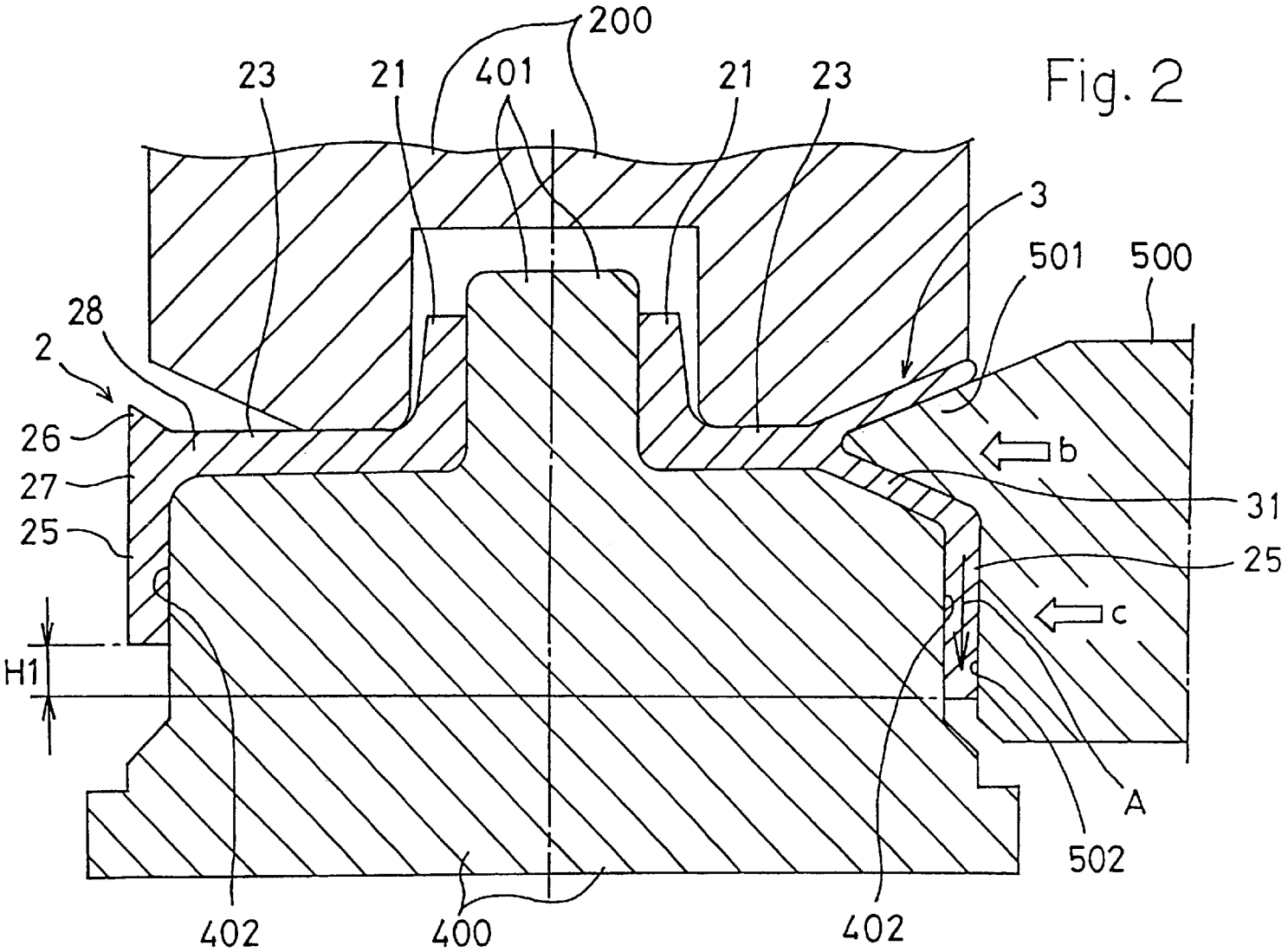
FIG. 2 is a section view showing a slitting step and a preliminary elongating step which are performed for forming a first valley portion in the sheet metal cylindrical member, thereby obtaining an intermediate shaped member.

In the present invention, a sheet metal cylindrical member 2 which is shown in the right half of FIG. 1 and the left half of FIG. 2 is used as a base material. In the embodiment, the sheet metal cylindrical member 2 is produced not by cutting but by a kind of a bending process. The production step will be described with reference to FIG. 1.

In the production step shown in FIG. 1, a rotary lower die 100 having a core portion 101 which is concentrical with the axis of rotation, a press die 200, a press shaping roller 300, and the like are used. As shown in the left half of FIG. 1, circular sheet metal material 1 having a cylindrical boss portion 21, which is formed by a burring process or the like and which has a constant height, is placed on the rotary lower die 100, and the boss portion 21 is fitted onto the core portion 101 of the rotary lower die 100. In a state where the sheet metal material 2 is pressingly held by the press die 200 and the rotary lower die 100, a kind of bending process is applied to an outer peripheral portion 22 (indicated by the phantom line) of the sheet metal material 1 which protrudes outside the rotary lower die 100 and the press die 200, thereby forming a circular base plate portion 23 and an inclined wall 24. As shown in the right half of FIG. 1, the inclined wall 24 is then pressed as indicated by the arrow a by the press shaping roller 300, so as to be further bent in a shape in which the wall is perpendicular to the base plate portion 23, thereby forming a cylindrical portion 25. The above-described step of producing the sheet metal cylindrical member 2 is an example, and the sheet metal cylindrical member 2 may be produced by another step. In the illustrated example, on the side of the base plate portion 23 of the sheet metal cylindrical member 2, the end of the cylindrical portion 25 is shaped by pressing using the shaping roller 300 so as to protrude from the base plate portion 23. An ear portion 26 which is formed in this way is useful to enable a slitting process which will be described later, to be surely performed.

As shown in the right half of FIG. 1 and the left half of FIG. 2, the sheet metal cylindrical member 2 which is produced by the above-mentioned step and which is used as a base material has the circular base plate portion 23, a cylindrical portion 25 extending in elongation on from the outer periphery of the base plate portion 23 on one side of the base plate portion 23, and the ear portion 26 extending in elongation on the other side of the base plate portion 23.

The thus produced sheet metal cylindrical member 2 is used as a base material in the method of producing a sheet metal pulley for a V belt of the present invention.

In the initial step of the embodiment of the production method, as shown in FIG. 2, the slitting step is performed in the cylindrical portion 25 on the one side of the base plate portion 23 and a first valley portion 31 is formed, and a preliminary elongating step is performed on the cylindrical portion 25 on the side opposite to the base plate portion 23 so that the cylindrical portion 25 is slightly elongated. In the initial step, a first rotary die 400 having a core portion 401 which is concentrical with the rotation axis, the press die 200, a first shaping roller 500, and the like are used. The press die 200 used in this step is identical with that described with reference to FIG. 1.

As shown in the left half of FIG. 2, the sheet metal cylindrical member 2 is pressingly held by the first rotary die 400 and the press die 200, and the boss portion 21 is fitted onto the core portion 401 of the first rotary die 400, whereby the sheet metal cylindrical member 2 is held in a fitted manner by the first rotary die 400. The sheet metal cylindrical member 2 which is held by the first rotary die 400 in this way is in a state where the back face of the cylindrical portion 25 is held by a receiving face 402 of the first rotary die 400. The first shaping roller 500 comprises a chevron slitting portion 501 having an annular shape, and a cylindrical press shaping face 502 which is adjacent to the slitting portion 501.

The slitting step is performed in the following manner. While rotating the sheet metal cylindrical member 2 which is held in a fitted manner by the first rotary die 400, together with the first rotary die 400, the slitting portion 501 of the first shaping roller 500 is pressed against the root portion 27 of the cylindrical portion 25 of the sheet metal cylindrical member 2 as shown by the arrow b in the right half of FIG. 2, so that the first shaping roller 500 is followingly rotated, thereby slitting the root portion 27 and the outer periphery 28 of the base plate portion 23 which is continuous to the root portion 27. When the slitting step is performed, the root portion 27 of the cylindrical portion 25, and the outer periphery 28 of the base plate portion 23 which is continuous to the root portion 27 are opened in a V-like shape, thereby forming the first valley portion 31. At this time, the preformation of the ear portion 26 is useful to form the first valley portion 31 into a suitable shape. If the slitting step is performed without forming the ear portion 26, there is a fear that the effective valley depth of the first valley portion 31 cannot be sufficiently ensured. Regarding this point, if the base plate portion 23 is sufficiently thick, the first valley portion 31 having a suitable shape can be formed even when the ear portion 26 is not preformed. Therefore, the embodiment has an advantage that the preformation of the ear portion 26 enables the first valley portion 31 having a suitable shape to be formed even when the base plate portion 23 is thin.

In the final stage of the slitting step, the cylindrical portion 25 is pressed against the receiving face 402 of the first rotary die 400 by the press shaping face 502 of the first shaping roller 500 as shown by the arrow c. Therefore, the cylindrical portion 25 is slightly elongated in the axial direction as indicated by the arrow A by the dimension indicated by H1 shown in FIG. 2, while being thinned. The preliminary elongating step is performed in this way.

As a result of the above-mentioned slitting and preliminary elongating steps, an intermediate shaped member 3 having the first valley portion 31 in the outer periphery of the base plate portion 23, and the elongated cylindrical portion 25 continuous to the first valley portion 31 is obtained.

Figure 3:
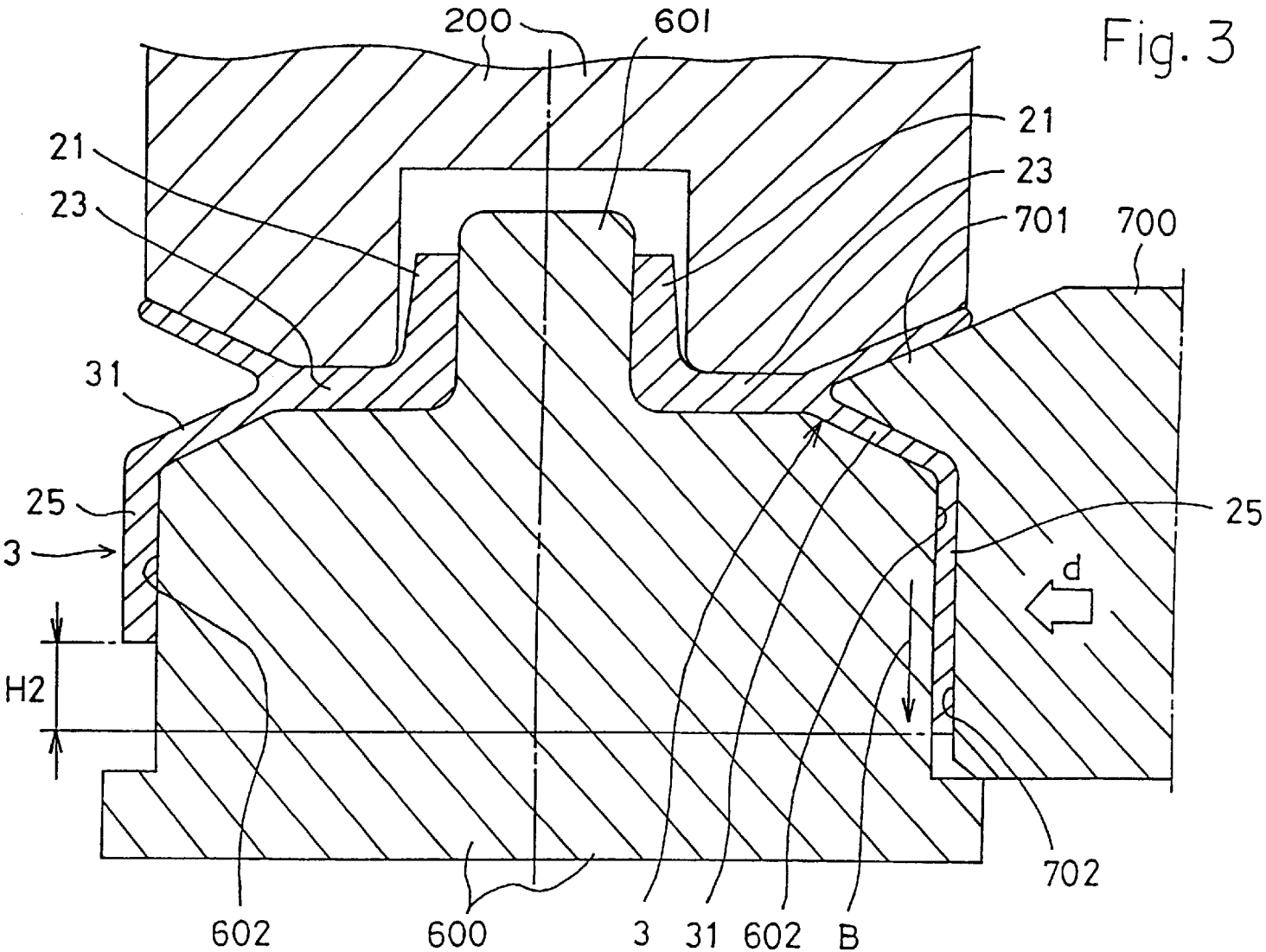
FIG. 3 is a section view showing a cylindrical portion elongating step which is performed for elongating the cylindrical portion of the intermediate shaped member.

The cylindrical portion 25 which has been elongated in the preliminary elongating step is further elongated so as to have a length sufficient for shaping a second valley portion 32 which will be described later. In this elongation, a first rotary die 600, the press die 200, and a first shaping roller 700, and the like which are shown in FIG. 3 are used. The press die 200 used in this step is identical with that described with reference to FIG. 1.

As shown in the left half of FIG. 3, the intermediate shaped member 3 is pressingly held by the first rotary die 600 and the press die 200, and the boss portion 21 is fitted onto a shaft portion 601 of the first rotary die 600, whereby the intermediate shaped member 3 is held in a fitted manner by the first rotary die 600. The intermediate shaped member 3 which is held by the first rotary die 600 in this way is in a state where the back face of the cylindrical portion 25 is held by a receiving face 602 of the first rotary die 600. The first shaping roller 700 comprises a chevron shape retaining portion 701 having an annular shape, and a cylindrical press shaping face 702 which is adjacent to the shape retaining portion 701.

As shown in the right half of FIG. 3, the cylindrical portion 25 of the intermediate shaped member 3 is pressed against the receiving face 602 of the first rotary die 600 by the press shaping face 702 of the first shaping roller 700 as shown by the arrow d, while the shape retaining portion 701 of the first shaping roller 700 is fitted into the first valley portion 31 of the intermediate shaped member 3. In this case, the intermediate shaped member 3 is rotated together with the first rotary die 600, and the first shaping roller 700 contacts the intermediate shaped member 3 to be followingly rotated. As a result, the cylindrical portion 25 is further elongated in the axial direction as indicated by the arrow B by the dimension indicated by H2 shown in FIG. 3, while being thinned. When the preliminary elongating step described with reference to the right half of FIG. 2 and the elongating step described with reference to the right half of FIG. 3 are performed, the cylindrical portion 25 of the intermediate shaped member 3 is elongated so as to have a sufficient length. Therefore, the above-described preliminary elongating step may be included in the elongating step described with reference to the right half of FIG. 3. In other words, the whole of the cylindrical portion elongating step for elongating the cylindrical portion 25 may be performed while being separated from the splitting step described with reference to the right half of FIG. 2. Alternatively, as in the case of the embodiment, a part of the cylindrical portion elongating step may be set to be the preliminary elongating step, and the preliminary elongating step may be performed in parallel with the splitting step.

Figure 4:
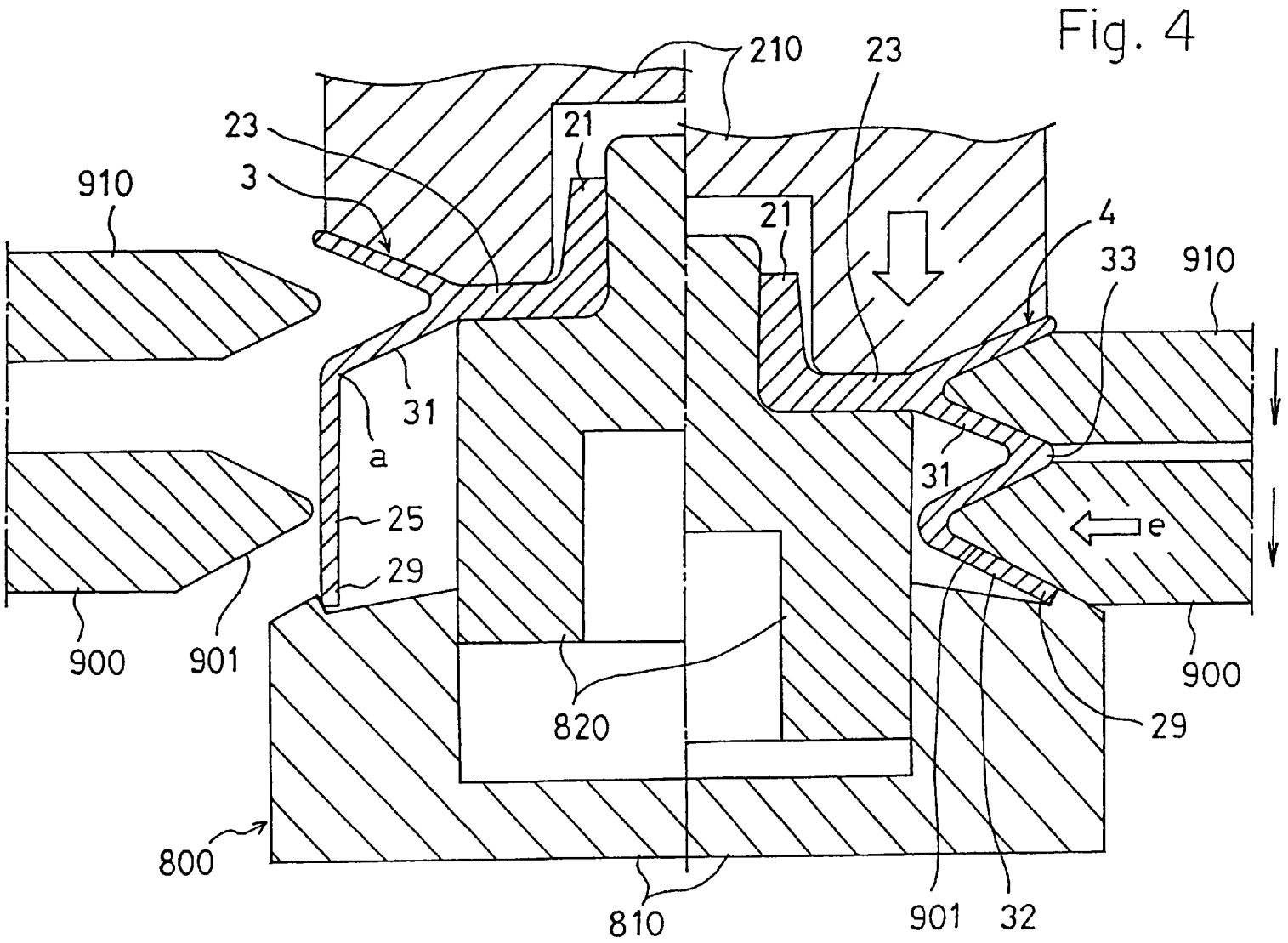
FIG. 4 is a section view showing a valley portion shaping step which is performed for forming a second valley portion in the intermediate shaped member.

A valley portion shaping step is performed on the intermediate shaped member 3 in which the first valley portion 31 has been formed in the splitting step and the cylindrical portion 25 has been elongated in the cylindrical portion elongating step. In the valley portion shaping step, a second rotary table 800 having a rotary table 800 and a movable table 810 which is concentric with the rotary table 800 and which is movable in the axial direction, a pressing member 210, a shape retaining roller 910, and a second shaping roller 900 which are shown in FIG. 4 are used. The pressing member 210 used in this step is identical with that described with reference to FIG. 1.

As shown in the left half of FIG. 4, in the valley portion shaping step, the base plate portion 23 of the intermediate shaped member 3 is supported by the movable table 820, and an open end 29 of the cylindrical portion 25 abuts against the rotary table 800. The shape retaining roller 910 and the second shaping roller 900 are configured so as to be movable in the axial direction of the rotary table 810.

In the valley portion shaping step, while rotating the intermediate shaped member 3 together with the rotary table 810 and the movable table 820, the shape retaining roller 910 is fitted into the first valley portion 31. While the open end 29 of the cylindrical portion 25 of the intermediate shaped member 3 is abutted against the rotary table 810 by pressing the intermediate shaped member 3 in the axial direction by the pressing member 210 so as to apply a pressing force in the axial direction to the cylindrical portion 25, an intermediate portion in the axial direction of the cylindrical portion 25 is pressed as indicated by the arrow e by a chevron shaping face 901 provided on the second shaping roller 900, thereby shaping the pressed place into the annular second valley portion 32 having a shape which extends along the chevron shaping face 901. In this case, the shape retaining roller 910 and the second shaping roller 900 contact the intermediate shaped member 3 to be followingly rotated.

As a result, while the diameter of the continuous place a between the first valley portion 31 and the cylindrical portion 25 is maintained as it is, only the place which is pressed by the chevron shaping face 901 of the second shaping roller 900 is bent so as to be annually recessed. Therefore, the second valley portion 32 having a suitable shape is formed into an annular shape, and the height of an annular chevron peak 33 formed between the first valley portion 31 and the second valley portion 32 is prevented from being lowered. This function is more remarkably exhibited by the configuration in which the open end 29 of the cylindrical portion 25 is positioned by abutting it against the rotary table 810.

As a result of the steps described above, a sheet metal pulley 4 for a V belt is shaped. The sheet metal pulley 4 for a V belt has the two or first and second valley portions 31, 32. In use, two separate V belts (not shown) are wound around the valley portions 31, 32, respectively.

Figure 5:
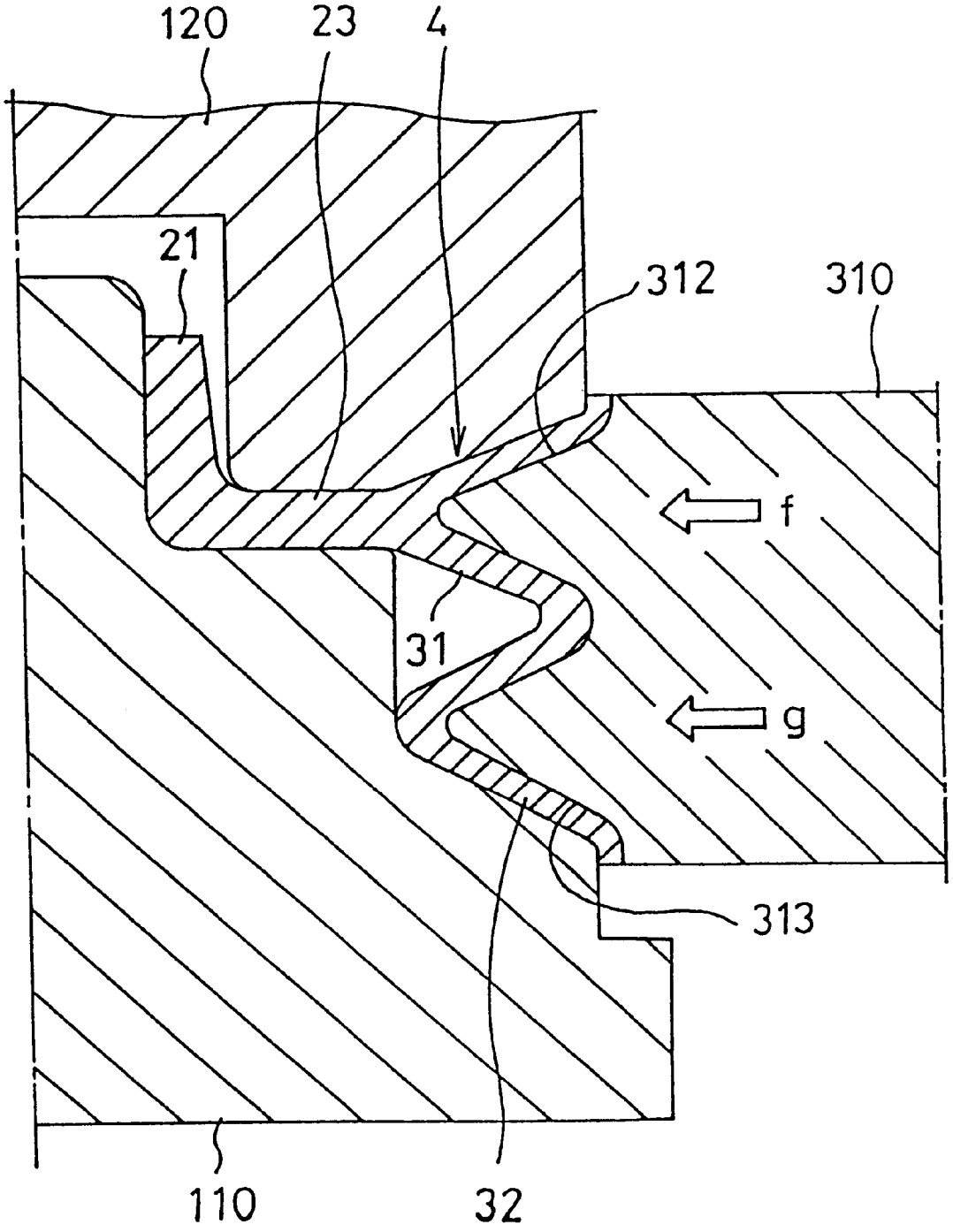
FIG. 5 is a section view showing a finishing step which is performed for enhancing accuracies of the first valley portion and the second valley portion.

In order to enhance accuracy of the dimensions and shape of the sheet metal pulley 4 for a V belt obtained after the valley portion shaping step which has been described with reference to the right half of FIG. 4, it is preferable to perform a finishing step shown in FIG. 5. In the finishing step, while the sheet metal pulley 4 for a V belt is held and rotated by a rotary lower die 110 and a press die 120, two chevron shaping faces 312, 313 of a finishing shaping roller 310 are pressed in a fitted manner against the first valley portion 31 and the second valley portion 32 as indicated by arrows f, g, respectively, thereby adjusting the faces.

In the embodiment, the method of producing the sheet metal pulley 4 for a V belt around which two separate V belts are to be wound has been described. Also a sheet metal pulley for a V belt around which three or more separate V belts are to be wound can be produced by a substantially same procedure. Namely, a sheet metal pulley for a V belt around which three or more separate V belts are to be wound must have three or more valley portions. Therefore, in the valley portion shaping step which has been described with reference to the right half of FIG. 4, while applying a pressing force in the axial direction to the cylindrical portion of the intermediate shaped member, plural places of an intermediate portion in the axial direction of the cylindrical portion are pressed in a radial direction to be inwardly bent, thereby shaping the pressed places into plural annular valley portions. According to this method, the height of an annular chevron peak formed between the valley portion formed by slitting and the plural valley portions formed by a kind of a bending process, and the heights of annular chevron peaks formed between the plural annular valley portions formed by a kind of a bending process are easily prevented from being lowered. This is useful to enhance the accuracy of the obtained sheet metal pulley for a V belt.

In the embodiment described above, the cylindrical portion of the sheet metal cylindrical member is elongated, and the elongated cylindrical portion is then bent inwardly to form a valley portion. Alternatively, in the case where the cylindrical portion of the original sheet metal cylindrical member is sufficiently long, the cylindrical portion may be immediately bent inwardly to form a valley portion, without elongating the cylindrical portion.

In the embodiment described above, after the formation of a valley portion by slitting is performed, the formation of a valley portion by bending is performed. Alternatively, the cylindrical portion 25 of the sheet metal cylindrical member 2 shown in FIG. 1 may be set to the rotary lower die 110 shown in FIG. 5, and the formation of a valley portion by slitting and that of a valley portion by bending may be simultaneously performed. In this case, when the valley portions are to be simultaneously formed, preferably, plural steps such as preliminary shaping and finishing shaping are repeated plural times in this sequence so that the valley portions are shaped to have a predetermined depth and a predetermined width by gradually increasing the depths and widths of the valley portions.

According to the present invention, using a sheet metal cylindrical member as a base material, a sheet metal pulley for a V belt around which two or plural V belts can be wound can be produced without performing cutting work. Therefore, a sheet metal pulley for a V belt which does not impair the environment of a factory, and which does not produce waste material can be produced.

We claim:

1. A method of producing a sheet metal pulley for a V belt from a sheet metal cylindrical member having a circular base plate portion and a cylindrical portion at an outer periphery of the circular base plate portion, the cylindrical portion extending in elongation on one side of the base plate portion, and defining a root portion, the method comprising the steps of: opening an annular first valley portion in a V-like shape by slitting the root portion of the cylindrical portion and the outer periphery of the base plate portion continuous to the root portion; preparing the cylindrical portion for a second valley portion to be continuous to the first valley portion, thereby together forming an intermediate shaped member which has the first valley portion in the outer periphery of the base plate portion and in which the cylindrical portion for forming the second valley portion is continuous to the first valley portion; and applying a pressing force in an axial direction to the cylindrical portion of the intermediate shaped member while rotating the intermediate shaped portion, and thereafter pressing an intermediate portion of the intermediate shaped member in the radial direction of the cylindrical portion to be inwardly bent, thereby shaping the pressed portion into the second valley portion.

2. A method of producing a sheet metal pulley for a V belt from a sheet metal cylindrical member having a circular base plate portion and a cylindrical portion at an outer periphery of the circular base plate portion, the cylindrical portion extending in elongation on one side of the base plate portion, and defining a root portion, the method comprising the steps of: opening an annular first valley portion in a V-like shape by slitting the root portion of the root portion of the cylindrical portion and the outer periphery of the base plate portion continuous to the root portion; elongating the cylindrical portion continuous to the first valley portion in an axial direction while being thinned, thereby together forming an intermediate shaped member which has the first valley portion in the outer periphery of the base plate portion and in which the elongated cylindrical portion is continuous to the first valley portion; and applying a pressing force in the axial direction to the elongated cylindrical portion of the intermediate shaped member while rotating the intermediate shaped portion, and thereafter pressing an intermediate portion of the intermediate shaped member in the radial direction of the cylindrical portion to be inwardly bent, thereby shaping the pressed portion into an annular second valley portion.

3. A method of producing a sheet metal pulley for a V belt from a sheet metal cylindrical member having a circular base plate portion and a cylindrical portion at an outer periphery of the circular base plate portion, the cylindrical portion extending in elongation on one saide of the base plate portion, and defining a root portion, the method comprising the steps of: opening an annular valley portion in a V-like shape by slitting the root portion of the cylindrical portion and the outer periphery of the base plate portion continuous to the root portion; preparing the elongated cylindrical portion for forming plural valley portions to be continuous to the formed valley portion, thereby together forming an intermediate shaped member which has the formed valley portion in the outer periphery of the base plate portion and in which the elongated cylindrical portion is continuous to the formed valley portion; and applying a pressing force in an axial direction to the cylindrical portion of the intermediate shaped member while rotating the intermediate shaped portions and thereafter pressing plural places of an intermediate portion of the intermediate shaped member in the radial direction of the cylindrical portion to be inwardly bent, thereby shaping the pressed places into plural annular valley portions.

4. A method of producing a sheet metal pulley for a V belt from a sheet metal cylindrical member having a circular base plate portion and a cylindrical portion at an outer periphery of the circular base plate portion, comprising the steps of holding the cylindrical member in a fitted manner by a first rotary die, the cylindrical portion extending in elongation on one side of the base plate portion and defining a root portion; opening an annular first valley portion in a V-like shape by slitting the root portion of the cylindrical portion and the outer periphery of the base plate portion continuous to the root portion with a chevron splitting portion provided on a first shaping roller while rotating the sheet metal cylindrical member together with the first rotary die; elongating the cylindrical portion in an axial direction while being thinned, by pressing the cylindrical portion against a receiving face of the first rotary die and using a shaping face provided on the first shaping roller, thereby forming an intermediate shaped member which has the first valley portion in the outer periphery of the base plate portion and in which the elongated cylindrical portion is continuous to the first valley portion; supporting the base plate portion of the intermediate shaped member by a movable table of a second rotary die the movable table being movable at a concentric position with respect to the rotary table and in an axial direction; and fitting a shape retaining roller into the first valley portion of the intermediate shaped member, while an open end of the cylindrical portion of the intermediate shaped member is abutted against the rotary table to apply a pressing force in the axial direction to the cylindrical portion by pressing the intermediate shaped member by a pressing member, an intermediate portion in the axial direction of the cylindrical portion is thereafter pressed by a chevron shaping face provided on a second shaping roller, thereby shaping the pressed place into an annular second valley portion having a shape which extends along the chevron shaping face.

* * * * *